US006508496B1

(12) United States Patent
Huang

(10) Patent No.: US 6,508,496 B1
(45) Date of Patent: Jan. 21, 2003

(54) MANUALLY-OPERATED DEVICE FOR PICKING UP OBJECTS

(76) Inventor: Tsung-Chi Huang, No. 303, Fu-Chien Rd., Fu-Hsing Hsiang, Chang Hua Hsien (TW)

( * ) Notice: Subject to any disclaimer, the term of this patent is extended or adjusted under 35 U.S.C. 154(b) by 0 days.

(21) Appl. No.: 10/122,906

(22) Filed: Apr. 16, 2002

(51) Int. Cl.[7] ..... B25J 1/02
(52) U.S. Cl. ..... 294/19.1; 294/115
(58) Field of Search ..... 294/11, 1.4, 19.1, 294/22, 23, 24, 50.8, 106, 115, 116

(56) References Cited

U.S. PATENT DOCUMENTS 528,827 A * 11/1894 Thomas ..... 294/19.1 X
1,967,731 A * 7/1934 Ackerson ..... 294/115
3,534,993 A * 10/1970 Le Vesque ..... 294/19.1 X
4,669,769 A * 6/1987 Polder ..... 294/19.1
4,962,957 A * 10/1990 Traber ..... 294/19.1
5,154,465 A * 10/1992 Pakosh ..... 294/19.1 X
6,257,634 B1 * 7/2001 Wei ..... 294/19.1

* cited by examiner

*Primary Examiner*—Johnny D. Cherry
(74) *Attorney, Agent, or Firm*—Harrison & Egbert

(57) ABSTRACT

A manual device includes a control lever pivoted to a hand grip for activating an activation rod so as to actuate an adjustment piece to cause two holding ends of two grasping arms to move toward each other to take hold of an object. The adjustment piece has a toothed bar. The grasping arms are provided with a toothed action end which is engaged with the toothed bar of the adjustment piece. As the adjustment piece is manually turned, the grasping arms are caused to move toward or away from each other such that the distance between the two holding ends of the two grasping arms is adjusted in accordance with the size of the object.

3 Claims, 7 Drawing Sheets

MANUALLY-OPERATED DEVICE FOR PICKING UP OBJECTS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a manual device which is provided with means to adjust two holding arms thereof in accordance with the size of an object to be picked up by the device.

BACKGROUND OF THE INVENTION

As shown in FIGS. 1 and 2, a prior art manual device is designed to pick up an object and is formed of a handle 10, a fixed member 11, a movable member 12, two connection rods 15 and 16, and two holding arms 13 and 14. The fixed member 11 is fastened at one end with the handle 10 and is provided with two lugs 111 and 112 for pivoting the two connection rods 15 and 16, which are provided with a pivoting portion 152, 162. The two holding arms 13 and 14 are pivoted at one end 131, 141 with the other end 151, 161 of the connection rods 15, 16 in conjunction with the movable member 12 and a locating pin 18. The movable member 12 is provided with an extension rod 121 and a spring 17 fitted over the extension rod 121. The extension rod 121 is connected via the fixed member 11 to an activation cord 19 which is disposed in the interior of the handle 10. In operation, activation cord 19 is triggered to cause the two holding arms 13 and 14 to move toward each other to grasp an object.

Such a prior art device as described is defective in design because the movable member 12 is not provided with means to adjust the distance between the two holding arms 13 and 14 in accordance with the size of an object to be picked up. It is therefore conceivably inconvenient to pick up the object with the prior art device. In addition, the prior art device is not provided with means to locate the activation cord 19 so as to enable the two holding arms 13 and 14 to take hold of the object continuously. Moreover, the holding arms 13 and 14 cannot be changed in the holding direction.

BRIEF SUMMARY OF THE INVENTION

The primary objective of the present invention is to provide a device for picking up an object. The device comprises a grasping member, a shank, an activation rod, a control lever, and a hand grip. The grasping member is formed of two grasping arms, and an adjustment piece which is engaged with an action end of the grasping arms. The shank is fastened at one end with the grasping member and at the other end with the hand grip. The activation rod is fastened at one end with the adjustment piece, and at the other end with the control lever which is pivoted at one end with the hand grip. The adjustment piece enables the two grasping arms to move toward or away from each other in accordance with the size of an object to be picked up. The hand grip is provided with means to locate the control lever so as to enable the two grasping arms to remain in the state of taking hold of the object.

The features and the advantages of the present invention will be more readily understood upon a thoughtful deliberation of the following detailed description of the present invention with reference to the accompanying drawings.

DETAILED DESCRIPTION OF THE INVENTION

Figure 1:
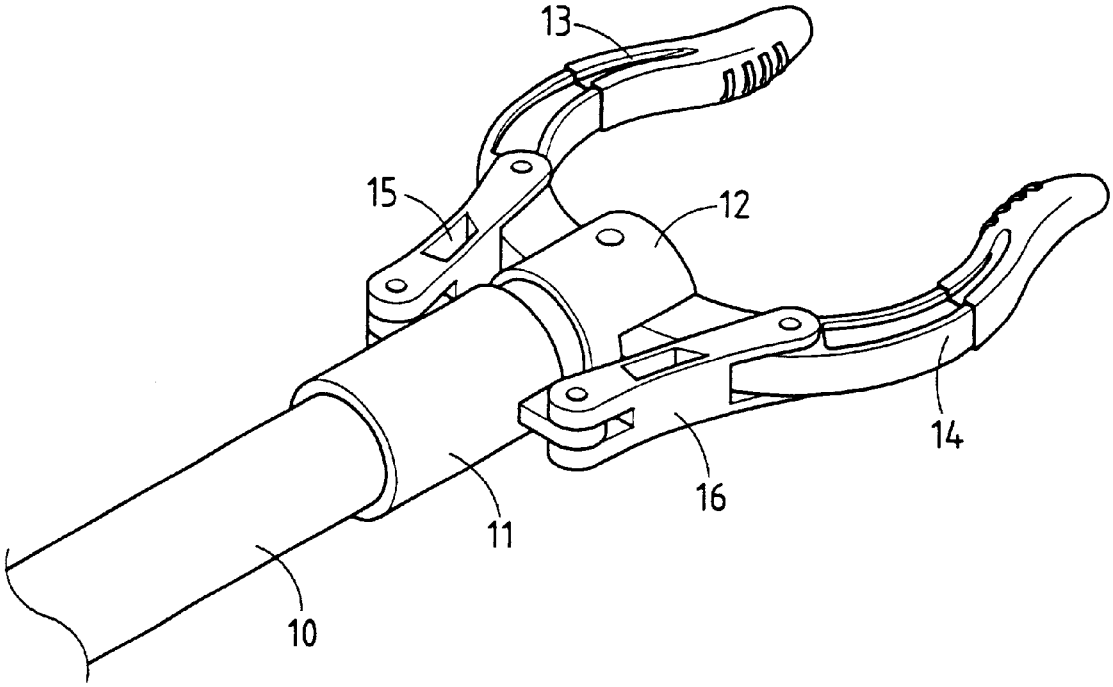
FIG.1 PRIOR ART
FIG. 1 shows a perspective view of a prior art device for picking up objects.
Figure 2:
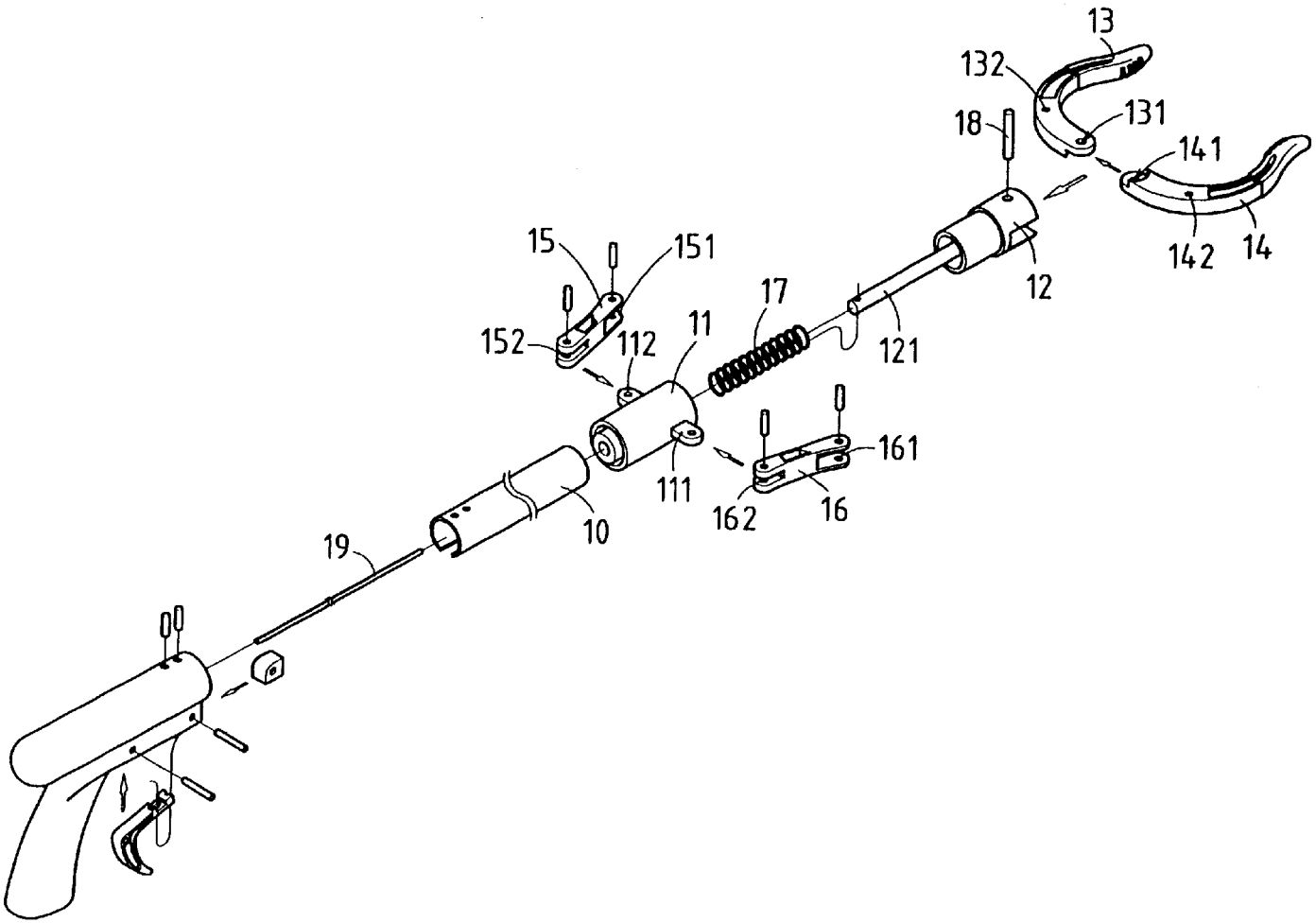
FIG. 2 PRIOR ART
FIG. 2 shows an exploded perspective view of the prior art device as shown in FIG. 1.

As shown in FIGS. 3–10, a manually-operated device of the present invention comprises a grasping member 20, a shank 31, an activation rod 30, a control lever 33, and two hand grip pieces 34 and 35.

The grasping member 20 is formed of a retaining piece 21, a first grasping arm 22, a second grasping arm 23, and an adjustment piece 24. The retaining piece 21 is fastened at one end with the shank 31 and is provided at the other end with a pivoting portion 212 for fastening pivotally an action end 221 of the first grasping arm 22 and an action end 231 of the second grasping arm 23. The action ends 221 and 231 are of a toothed construction. The first grasping arm 22 has a holding end 222 to take hold of an object. Similarly, the second grasping arm 23 has a holding end 232 serving to take hold of the object. The adjustment piece 24 is rotatably disposed in the other end of the retaining piece 21 in conjunction with a spring 25 which urges the adjustment piece 24. The adjustment piece 24 has a toothed bar 241 which is designed to mesh with the toothed action ends 221 and 231.

The activation rod 30 is fastened at one end with the control lever 33 by a fastener 32, and at the other end with the adjustment piece 24 via the interiors of the shank 31 and the retaining piece 21, and through the spring 25. In must be noted here that one end of the spring 25 is stopped by a stop edge (not shown in the drawing) located in the interior of the retaining piece 21. The spring 25 has another end which urges the toothed bar 241 of the adjustment piece 24.

Figure 3:
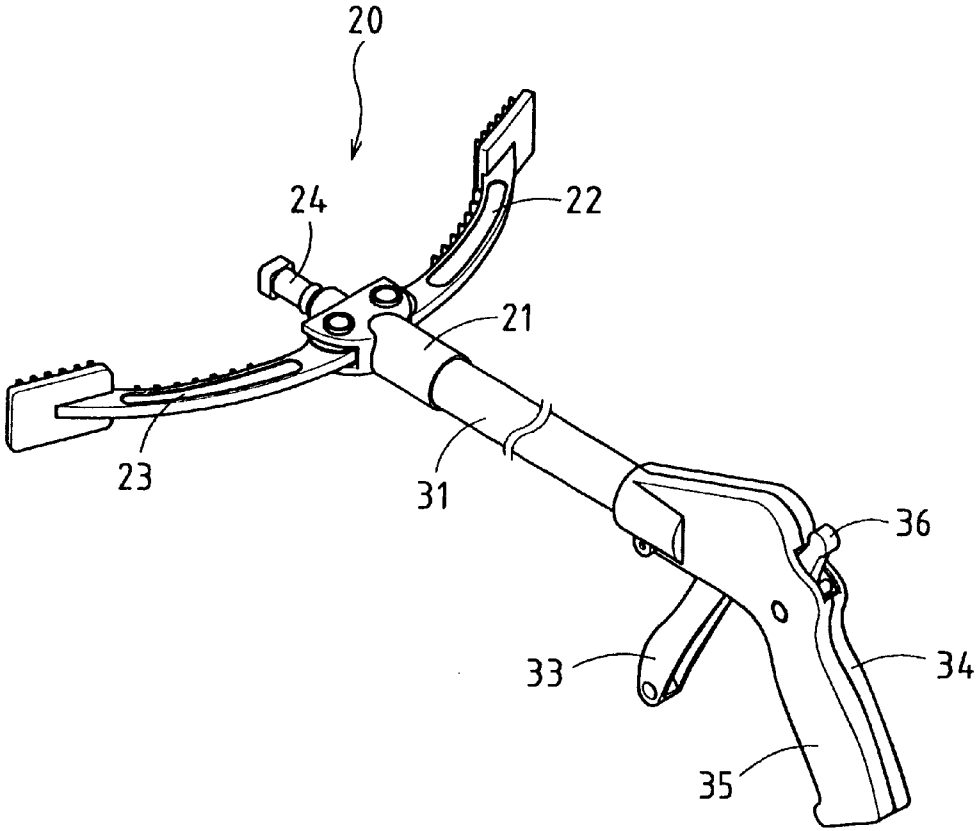
FIG. 3 shows a perspective view of the present invention.
Figure 4:
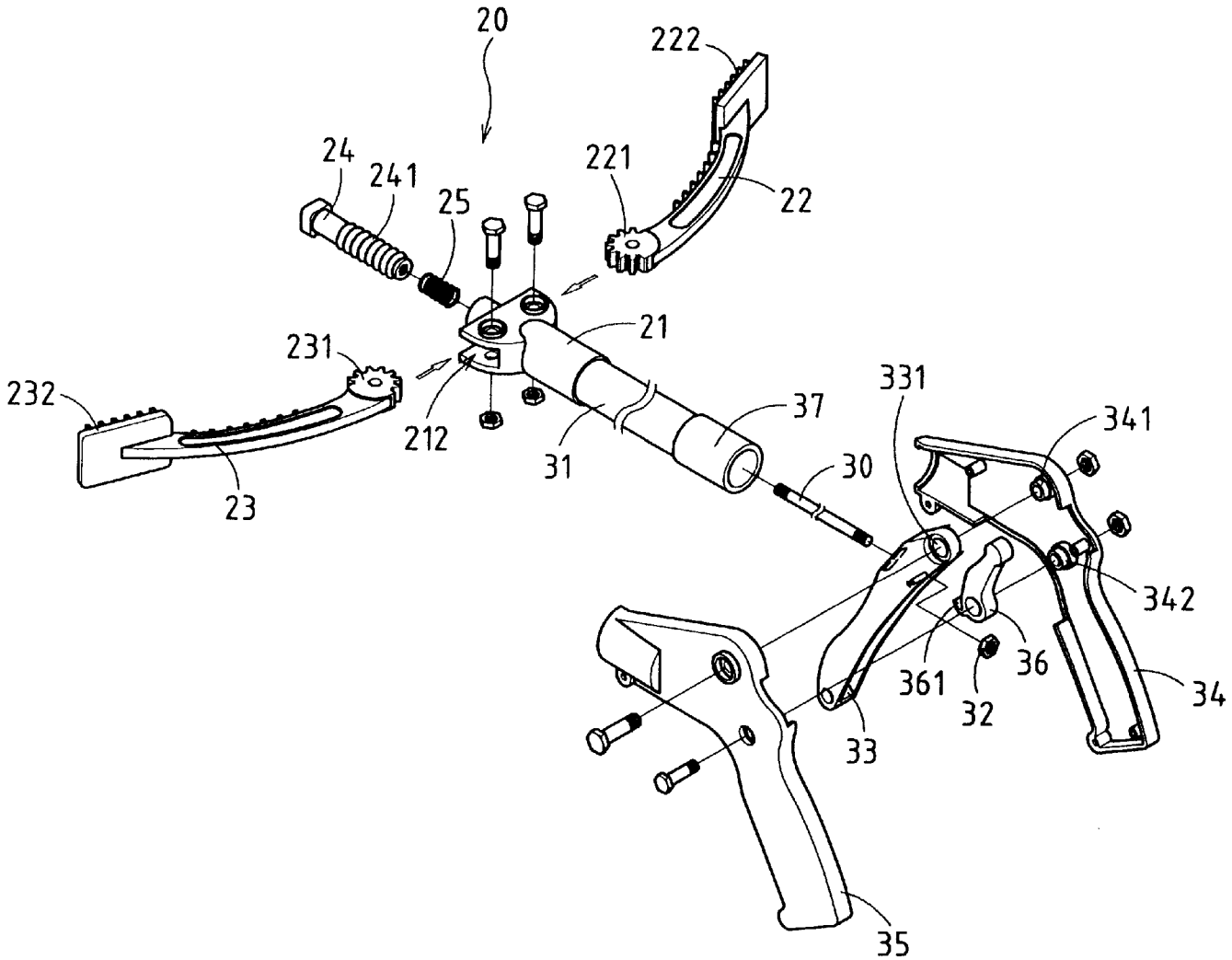
FIG. 4 shows an exploded perspective view of the present invention.
Figure 5:
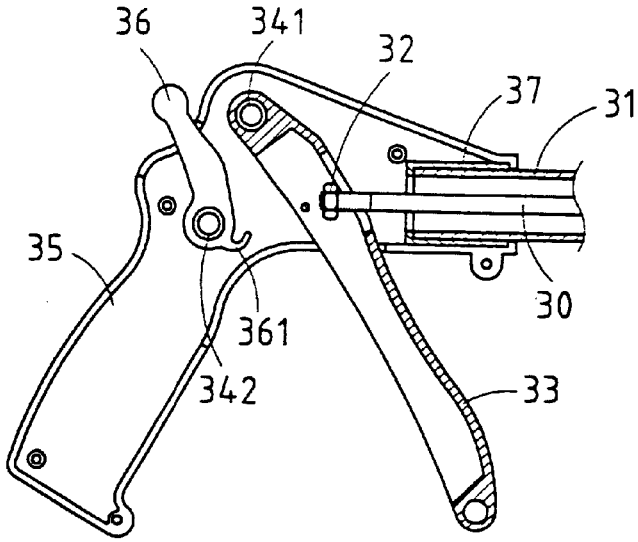
FIG. 5 shows a sectional view of the hand grip and the control lever of the present invention.
Figure 6:
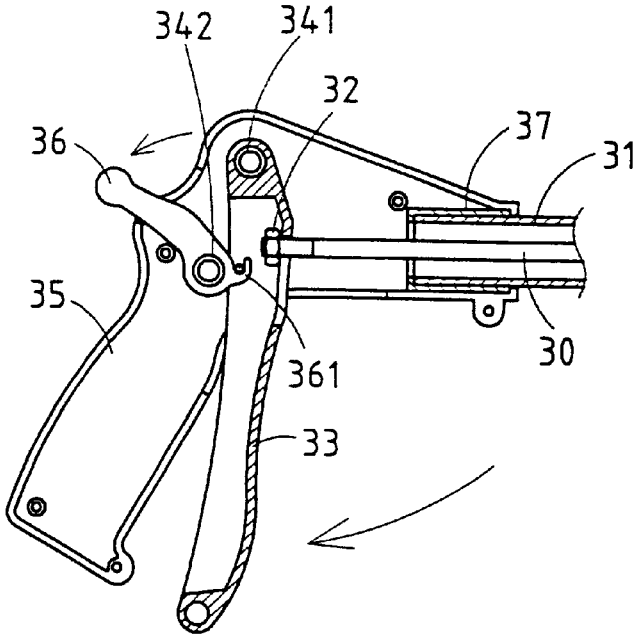
FIG. 6 shows a sectional schematic view of the control lever being located by a locating piece of the present invention.

The control lever 33 is provided at one end with a pivoting hole 331. The first hand grip piece 34 is provided with a first pivoting portion 341 and a second pivoting portion 342. The control lever 33 is pivoted to the first pivoting portion 341 by the pivoting hole 331. A locating piece 36 is pivoted to the second pivoting portion 342 and is provided with a hooked portion 361 for catching the control lever 33 so as to locate the control lever 33 at a predetermined position, as shown in FIG. 6. The second hand grip piece 35 is joined with the first hand grip piece 34 such that the control lever 33 and the locating piece 36 are jutted out of the hand grip pieces 34 and 35, as shown in FIGS. 3, 5, and 6. The control lever 33 and the locating piece 36 are thus accessible to fingers of a user of the device of the present invention.

The shank 31 is fastened at one end with the first hand grip piece 34 and the second hand grip piece 35 in conjunction with a sleeve 37. The shank 31 can be turned in relation to the sleeve 37.

Figure 7:
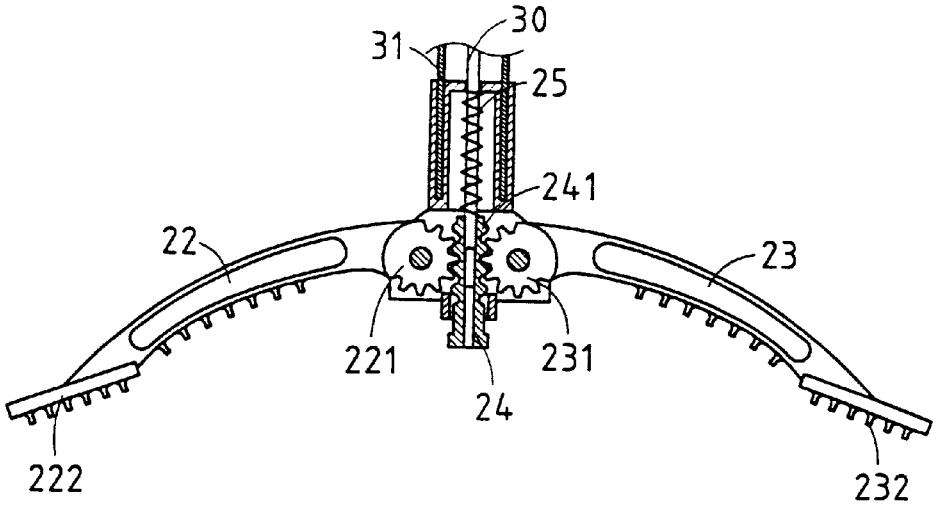
FIG. 7 shows a sectional schematic view of the grasping member and the adjustment piece of the present invention.
Figure 8:
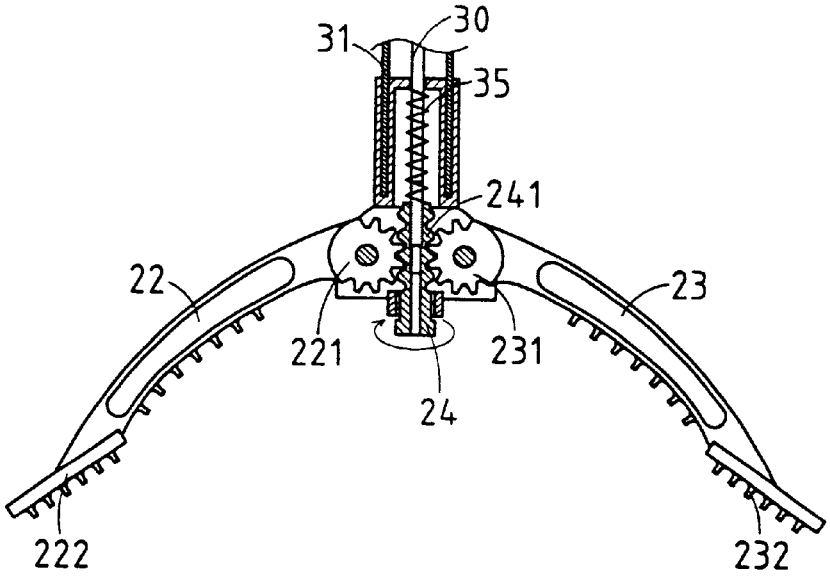
FIG. 8 shows a sectional schematic view of the grasping member and the adjustment piece at work to adjust the grasping member of the present invention.

The holding end 222 of the first grasping arm 22 and the holding end 232 of the second grasping arm 23 work in tandem to pick up an object. The distance between the two holding ends 222 and 232 can be adjusted in accordance with the size of the object by turning the adjustment piece 24, as illustrated in FIGS. 7 and 8. In light of the toothed bar 241 of the adjustment piece 24 being engaged with the toothed action ends 221 and 231 of the grasping arms 22 and 23, the toothed bar 241 in motion can actuate the action ends 221 and 231 of the two grasping arms 22 and 23 to turn so as to cause the two grasping arms 22 and 23 to move toward or away from each other, depending on the direction in which the adjustment piece 24 is turned.

Figure 9:
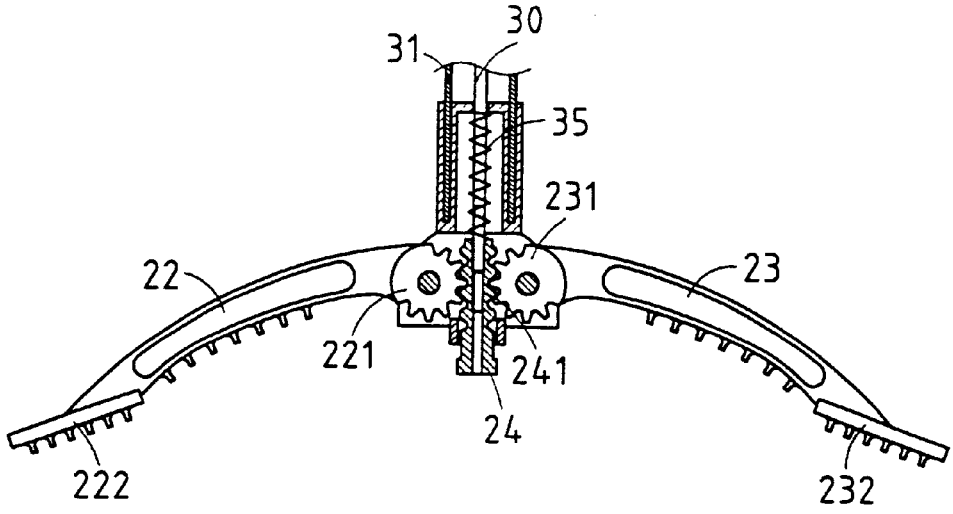
FIG. 9 shows a sectional schematic view of the present invention on standby.
Figure 10:
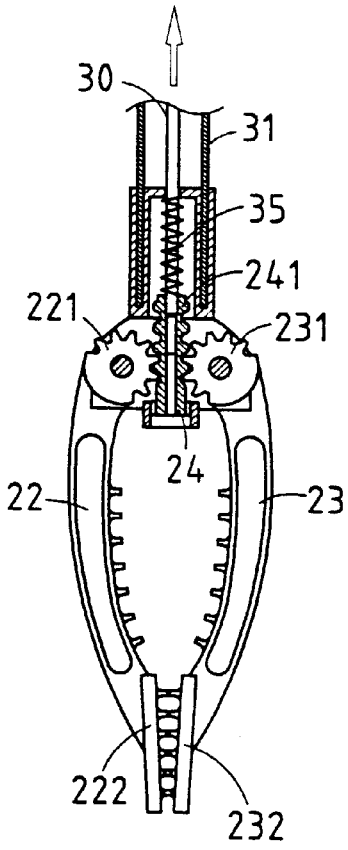
FIG. 10 shows a sectional schematic view of the present invention in action.

In view of the fact that the adjustment piece 24 is fastened with the activation rod 30 which is in turn fastened with the control lever 33, the two grasping arms 22 and 23 can be actuated by the control lever 33 to move toward or away from each other, as shown in FIGS. 9 and 10. As soon as the object is taken hold of by the holding ends 222 and 232 of the two grasping arms 22 and 23, the control lever 33 can be located by the locating piece 36 such that the control lever 33 is releasably caught by the hooked portion 361 of the locating piece 36, as shown in FIG. 6. As a result, the control lever 33 is so located that the finger of a user of the device is relieved of the burden to keep pressing the control lever 33.

In light of the shank 31 capable of being turned in relation to the sleeve 37 which is fastened with the two hand grip pieces 34 and 35, the two grasping arms 22 and 23 can be changed in direction in which an object is easily picked up by the two holding ends 222 and 232 of the two grasping arms 22 and 23.

The present invention described above is to be regarded in all respects as being merely illustrative and nonrestrictive. Accordingly, the present invention may be embodied in other specific forms without deviating from the spirit thereof The present invention is therefore to be limited only by the scope of the following claims.

I claim:

1. A manually-operated device for picking up an object, said device comprising:

a hand grip provided in an interior with a pivoting portion;

a control lever pivoted at one end with said pivoting portion such that another end of said control lever juts out of said hand grip;

a shank fastened at one end to said hand grip and provided with a hollow interior;

an activation rod fastened at one end to said control lever such that said activation rod is received in the hollow interior of said shank;

a retaining piece fastened at one end to another end of said shank and provided at another end thereof with a pivoting portion;

an adjustment piece comprising a toothed bar, said toothed bar comprising one end which is fastened to another end of said activation rod in conjunction with a spring; and two grasping arms comprising, at one end, a toothed action end, and at another end, a holding end, said two grasping arms being pivoted at the one end thereof with said pivoting portion of said retaining piece such that said toothed action ends of said two grasping arms are engaged with said toothed bar of said adjustment piece, thereby enabling said two grasping arms to move toward or away from each other by turning said adjustment piece whereby said adjustment piece is actuated to move linearly by said activation rod at such time when said control lever is triggered, thereby causing said two holding ends of said two grasping arms to move toward each other to take hold of an object.

2. The device as defined in claim 1, wherein said one end of said shank is comprised of a sleeve whereby said sleeve is fastened at one end to said hand grip such that said one end of said shank is rotatably disposed in another end of said sleeve, thereby enabling said two grasping arms to turn along with said shank at the time when said one end of said shank is turned in relation to said sleeve.

3. The device as defined in claim 1, wherein said hand grip is further comprised of, in the interior with a second pivoting portion and a locating piece whereby said locating piece is pivoted at one end with said second pivoting portion such that another end of said locating piece juts out of said hand grip, said locating piece being comprised of a hooked portion for catching releasably said control lever so as to locate said control lever at a predetermined position in the wake of an action by which said control lever is triggered.

* * * * *